US005933939A

United States Patent [19]

Nomerange et al.

[11] Patent Number: 5,933,939

[45] Date of Patent: Aug. 10, 1999

[54] PROCESS FOR PRODUCING A COMMUTATOR OF A ROTATING MACHINE

[75] Inventors: Hervé Nomerange, Caen; Jérôme Quere, Mondeville, both of France

[73] Assignee: Meritor Light Vehicle Systems-France, France

[21] Appl. No.: 08/950,651

[22] Filed: Oct. 15, 1997

[30] Foreign Application Priority Data

Oct. 16, 1996 [FR] France ..... 96 12637

[51] Int. Cl.[6] ..... H01R 43/06

[52] U.S. Cl. ..... 29/597; 310/235

[58] Field of Search ..... 29/597

[56] References Cited

U.S. PATENT DOCUMENTS

| | | | |
|---|---|---|---|
| 840,451 | 1/1907 | Fuld | 29/597 |
| 1,993,966 | 3/1935 | Kessler | 29/597 |
| 2,104,141 | 1/1938 | Stevens, Jr. | 29/597 |
| 3,958,326 | 5/1976 | Matsumoto et al. | 29/597 |
| 4,559,464 | 12/1985 | Stokes | 310/233 |
| 4,667,394 | 5/1987 | Bode et al. | 29/597 |

*Primary Examiner*—Carl E. Hall
*Assistant Examiner*—David Caputo

[57] ABSTRACT

The process comprises forming a tube (1) of an electrically conductive material having on its inner surface axial grooves (2) and axial projecting portions (3) between the latter, injecting a hardenable insulating material (4) into the tube (1) so as to fill the latter, this material penetrating the grooves and surrounding the projecting portions, and removing the outer portion of the tube (1) after the hardening of the insulating material so as to reveal the insulating material of the grooves (2) and form between the latter commutator segments which are insulated from one another. The tube (1) is formed by the extrusion of two complementary half-tube shells (1*a*, 1*b*) and the assembly of the latter one against the other on an axial joint plane (A—A).

6 Claims, 2 Drawing Sheets

PROCESS FOR PRODUCING A COMMUTATOR OF A ROTATING MACHINE

Figure 1:
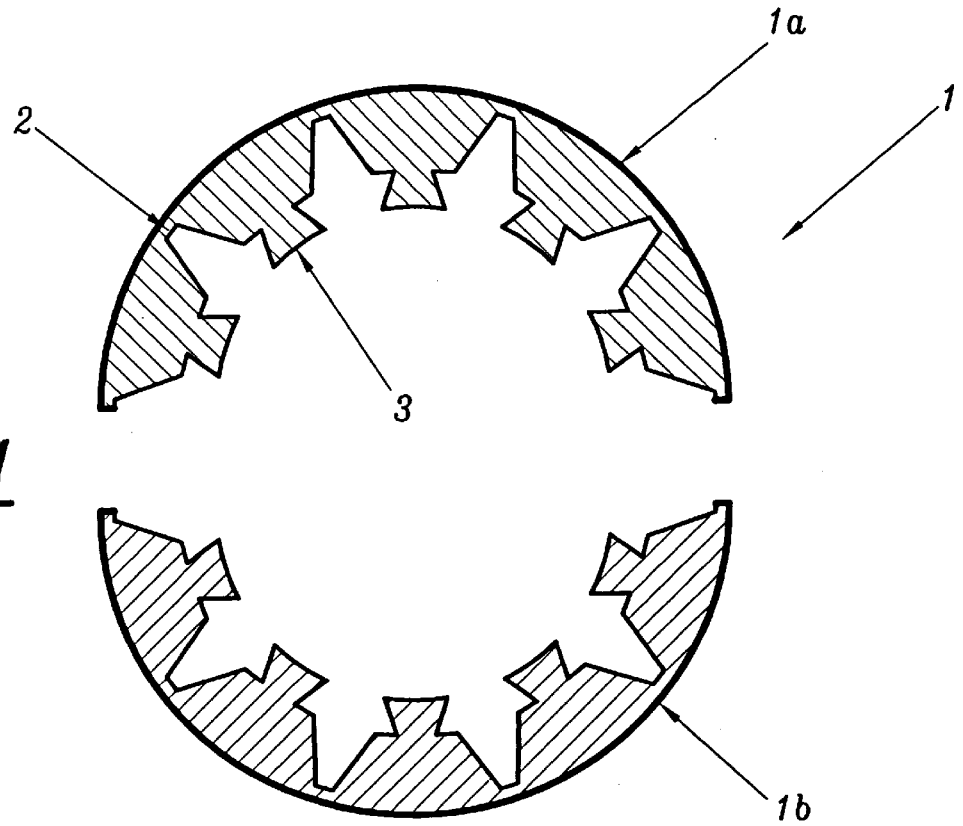
Figure 2:
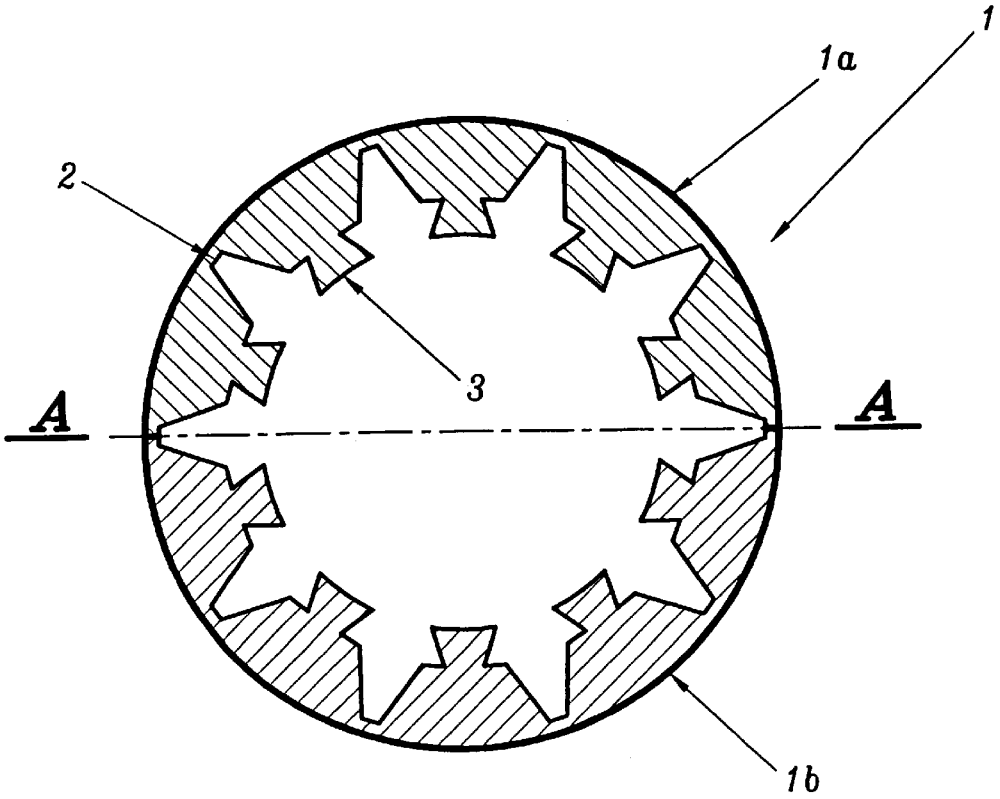

The present invention relates to a process for producing a commutator of a rotating machine and a commutator produced by said process.

More particularly, the present invention relates to a process for producing a collector of the insulated type, i.e. in which the insulating material is provided in the spaces between the commutator segments.

These prior insulated commutators were developed for reducing noise emitted by the motors when the brushes encounter the segments of the commutators.

Some processes for producing this type of prior commutators comprise producing the segments separately, disposing them in a moulding jig and then injecting into the latter a hardenable insulating material which permits forming the commutator.

Other processes known in the art comprise employing a tube of a conductive material, disposing it in a moulding jig and then injecting an insulating material into the latter to form the commutator.

In the two preceding cases, it is thereafter necessary to mill spaces between the segments to electrically insulate the segments of the commutator from one another, and effect a turning or grinding operation to obtain a suitable surface state between the brushes and the outer surface of the commutator and minimize the wear of the brushes and the noises created by the friction between the brushes and the commutator when the latter rotates.

However, it will be understood that these different operations, and in particular the milling of spaces between the segments, have a number of drawbacks.

There is also known, for example from the document GB A-677 779, a process for producing a commutator according to the preamble of claim 1.

However, in this document, the tube is obtained by cold-forming a blank, which presents drawbacks in particular as concerns the cost of producing this tube.

An object of the invention is therefore to overcome these problems.

For this purpose, the invention provides a process for producing a commutator of a rotating machine, comprising:

forming a tube of an electrically conductive material having on its inner surface axial grooves and, between the latter, axial projecting portions, injecting a hardenable insulating material into the tube so as to fill the latter, said material penetrating the grooves and surrounding the projecting portions, and removing the outer portion of the tube after the hardening of the insulating material so as to reveal the insulating material of the grooves and form between said grooves collector segments which are insulated from one another, characterized in that the tube is formed by extrusion of two complementary half-tube shells and the assembly of the half-tube shells one against the other on an axial joint plane.

According to another aspect, the invention also provides a commutator obtained by said process.

A better understanding of the invention will be had from the following description which is given solely by way of example with reference to the accompanying drawings, in which:

FIGS. 1–4 illustrate the various steps of a process for producing a commutator according to the invention.

As can be seen in these Figures, this process for producing a commutator of a rotating machine, for example a motor, comprises, in a first step, extruding two complementary half-tube shells 1*a* and 1*b* (FIG. 1) and, in a second step, assembling them one against the other on an axial joint plane A—A (FIG. 2) so as to form a tube of an electrically conductive material, designated by the general reference numeral 1 in these Figures, this tube of an electrically conductive material having on its inner surface axial grooves such as for example the groove designated by the general reference numeral 2 and, between said grooves, projecting portions such as the projecting portion 3.

These projecting portions may have for example a dovetail cross-sectional shape, while the grooves may have a cross-sectional shape which decreases in the direction outwardly of the tube.

The extrusion of these complementary half-tube shells is achieved in the conventional manner by means of a suitable machine and a suitable extrusion die.

Preferably, the axial joint plane A—A of the two half-tube shells passes through grooves of the tube.

It will be understood that different arrangements and shapes of these axial grooves and axial projecting portions may be envisaged.

Figure 3:
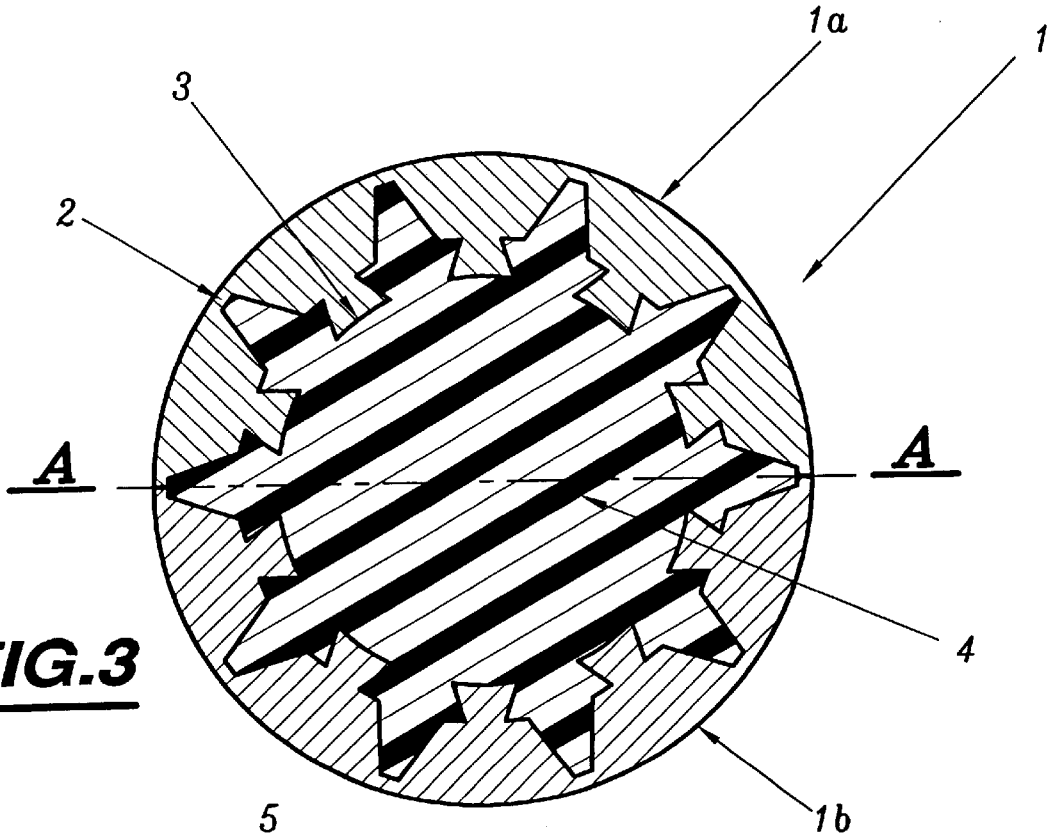

After having formed this tube 1 of an electrically conductive material, a hardenable insulating material 4 is injected into the tube so as to fill the latter, this material therefore penetrating the axial grooves 2 of the tube and surrounding the axial projecting portions 3, as seen in FIG. 3.

Figure 4:
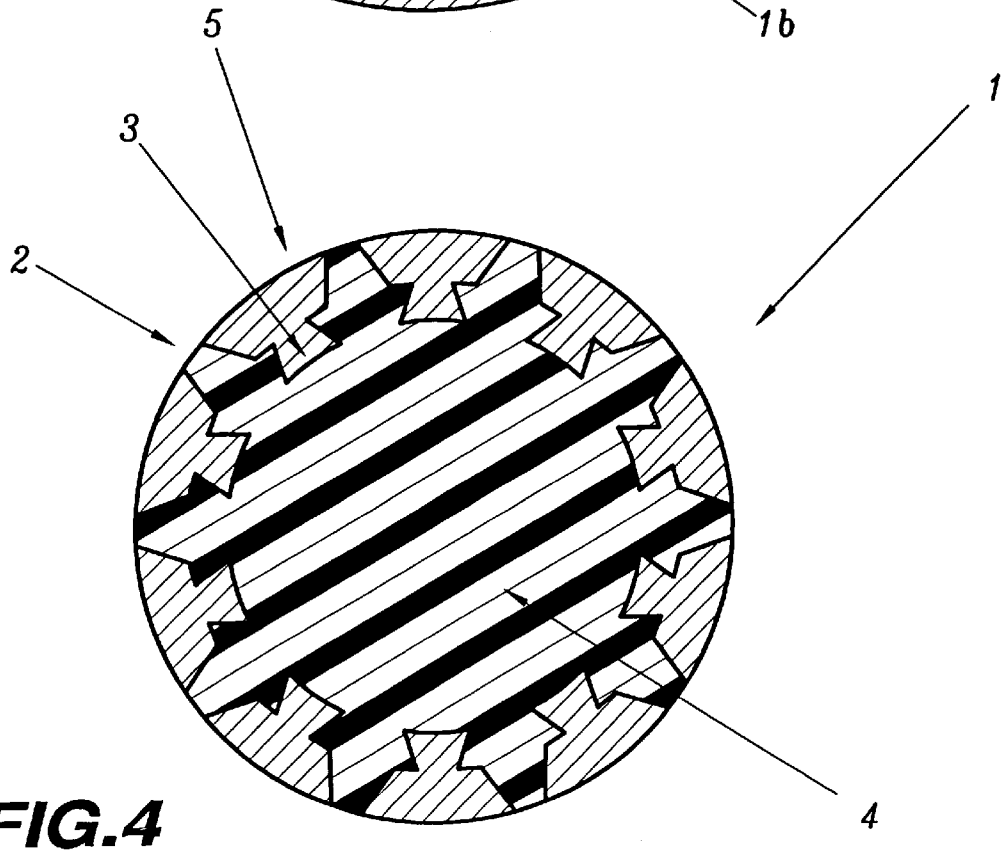

After the hardening of this insulating material 4, with the half-tube shells 1*a* and 1*b* consequently fixed to each other, the outer portion of the tube 1 is removed, for example by a machining or some other operation, so as to reveal the insulating material in the grooves 2 and form between the latter commutator segments which are insulated from one another, as shown by the segment designated by the general reference numeral 5 in FIG. 4.

It will consequently be understood that the axial projecting portions, for example 3, formed between the grooves and associated with each segment of the commutator, ensure a good fastening of the segments formed in this way on the insulating material injected into the tube.

Further, as the axial joint plane A—A of the two half-tube shells passes through the grooves of the latter, the assembling regions of the half-tube shells disappear in the course of the removal of the outer portion of the tube.

The operations for connecting these commutator segments to the windings of the rotating machine are conventional and well known in the art and need not be described in detail hereinafter.

However, it should be noted that these operations for example comprise forming on each commutator segment a fastening lug to which a corresponding winding of the machine is fastened.

It will of course be understood that various materials may be used for forming the tube of an electrically conductive material, and various insulating materials may be used for injecting into the tube.

The commutator formed in this way may be subsequently made a part of the construction of an electric motor or generator.

The latter may then be associated with a shaft in the mould when injecting the insulating material into the tube or fixed to this commutator subsequent to the operations for producing the latter.

The step for removing the outer portion of the tube may be for example a machining step, but it will be understood that other material-removing techniques may also be envisaged.

It will be therefore understood that the process according to the invention permits producing a commutator at a relatively low cost.

What is claimed is:

1. A method for producing a commutator for a rotating machine comprising the steps of:

(1) forming at least two complimentary shells of an electrically conductive material each shell having an inner surface on which are provided axial grooves and axial projecting portions between said axial grooves, said at least two complimentary shells each having a shape such that they can be placed in contact with each other to define a generally cylindrical tube, each of said at least two shells including at least two of said axial grooves and at least two projecting portions projecting from each of said at least two shells;

(2) assembling said at least two shells together to form a tube;

(3) injecting a hardenable insulating material into said core to fill the interior of said core, and causing said insulating material to penetrate said axial grooves, and surround said projecting portions; and (4) removing an outer portion of said tube after hardening of said insulating material, with the removal of material continuing radially inwardly until portions of insulating material with said groove are exposed, and such that the number of said portions of insulating material is greater than, the number of shells assembled together to form a tube and with electrically conductive material being left from said at least two shells at areas circumferentially aligned with said portions of insulating material.

2. A method as recited in claim 1, wherein said projecting portions have a dove tail cross-sectional shape.

3. A method as recited in claim 1, wherein said axial grooves have a cross-sectional shape which decreases in a direction towards an exterior of said tube.

4. A method as recited in claim 1, wherein there are two of said tube portions each having a generally semi-cylindrical shape.

5. A method as set forth in claim 4, wherein a joint plane is defined between said two tube portions, said joint plane passing through one of said portions of insulating material. said insulating material.

6. A method as set forth in claim 1, wherein the removal of step (4) includes removing material from locations at an outer periphery of the tube circumferentially spaced from the locations of said axial grooves.

* * * * *